United States Patent [19]

Baltz

[11] Patent Number: 4,809,666

[45] Date of Patent: Mar. 7, 1989

[54] FUEL FEED SYSTEM

[75] Inventor: Gene F. Baltz, Lake Villa, Ill.

[73] Assignee: Outboard Marine Corporation, Waukegan, Ill.

[21] Appl. No.: 820,129

[22] Filed: Jan. 21, 1986

[51] Int. Cl.[4] ..... F02M 37/20

[52] U.S. Cl. ..... 123/516; 123/510

[58] Field of Search ..... 123/457, 458, 460, 461, 123/497, 510–516; 180/69.4, 69.6

[56] References Cited

U.S. PATENT DOCUMENTS

| | | | |
|---|---|---|---|
| 1,269,787 | 6/1918 | Church | 123/516 |
| 1,404,152 | 1/1922 | Kettering | 123/497 |
| 2,155,287 | 4/1939 | Wolf | 180/69.6 |
| 2,191,490 | 2/1940 | Mitterer . | |
| 2,323,525 | 7/1943 | Ebel et al. | 123/516 X |
| 2,378,810 | 6/1945 | Thornton | 180/69.6 X |
| 2,445,113 | 7/1948 | Green et al. . | |
| 2,969,110 | 1/1961 | Jordan . | |
| 3,314,665 | 4/1967 | Tutch . | |
| 3,319,613 | 5/1967 | Begley et al. | 123/458 X |
| 3,502,895 | 3/1970 | Ballou | 123/497 X |
| 3,548,796 | 12/1970 | Gastinne | 123/510 X |
| 3,709,202 | 1/1973 | Brown . | |
| 4,129,106 | 12/1978 | Sellman . | |
| 4,168,687 | 9/1979 | Kurahashi et al. | 123/516 X |
| 4,385,615 | 5/1983 | Keane | 123/514 |
| 4,448,157 | 5/1984 | Eckstein et al. | 123/179 E X |
| 4,450,820 | 4/1984 | Haynes . | |
| 4,531,379 | 7/1985 | Diefenthaler, Jr. | 123/DIG. 8 X |
| 4,543,938 | 10/1985 | Szlaga | 123/516 X |

FOREIGN PATENT DOCUMENTS

| | | | |
|---|---|---|---|
| 497473 | 12/1938 | United Kingdom | 123/516 |
| 2140091 | 11/1984 | United Kingdom | 123/510 |

*Primary Examiner*—Tony M. Argenbright

*Attorney, Agent, or Firm*—Michael, Best & Friedrich

[57] ABSTRACT

A fuel feed system for supplying fuel to a combustion chamber of a first internal combustion engine and to a combustion chamber of a second internal combustion engine. The fuel feed system includes a fuel tank, and a first fuel pump including an outlet, and an inlet communicating with the fuel tank. The system also includes a fuel vapor separator including a first outlet, a second outlet, and an inlet communicating with the first fuel pump outlet, a second fuel pump communicating with the fuel vapor separator first outlet and communicating with the first engine combustion chamber, and a third fuel pump communicating with the fuel vapor separator second outlet and communicating with the second engine combustion chamber.

13 Claims, 1 Drawing Sheet

FUEL FEED SYSTEM

BACKGROUND OF THE INVENTION

This invention relates to fuel feed systems for supplying fuel to an internal combustion engine, particularly marine engines, and, more particularly, to such fuel feed systems which include a fuel vapor separator.

Attention is directed to the fuel vapor separator illustrated in U.S. Pat. No. 1,269,787 issued June 18, 1918. Attention is also directed to the fuel feed systems illustrated in the following U.S. patents.

| PATENTEE | U.S. PAT. NO. | ISSUE DATE |
|---|---|---|
| Mitterer | 2,191,490 | February 27, 1940 |
| Ebel, et al. | 2,323,525 | July 6, 1943 |
| Green, et al. | 2,445,113 | July 13, 1948 |
| Jordan | 2,969,110 | January 24, 1961 |
| Tutch | 3,314,665 | April 18, 1967 |
| Brown | 3,709,202 | January 9, 1973 |
| Sellman | 4,129,106 | December 12, 1978 |
| Kurahashi, et al. | 4,168,687 | September 25, 1979 |
| Keane | 4,385,615 | May 31, 1983 |
| Haynes | 4,450,820 | May 29, 1984 |

Attention is also directed to Walsworth U.S. Pat. No. 4,539,949 issued Sept. 10, 1985, which is incorporated herein by reference.

Present marine engines have the fuel feeding system of the boat located on the suction side of the engine fuel pump. The tank, fuel feeding line(s), tank switching valve(s), anti-siphon valve(s) and fuel filter(s) of a typical boat mounted fuel feeding system require the engine mounted fuel pump to draw fuel (under vacuum) through the system prior to delivery to the engine fuel system which primarily includes a carburetor and fuel pump.

Such typical marine fuel feeding systems involve a restriction to fuel flow due to the sum of the pressure-drops across the individual components of the fuel feeding system. The distribution system requires fuel pump vacuum to pull the fuel through the fuel feed system at a sufficient rate to supply the fuel demand requirements of the engine. The sum of the pressure-drops (resistance to flow) of the fuel feeding system and the vacuum required for sufficient flow leads to a tendency for the fuel to flash into a vapor, commonly referred to as vapor lock. The tendency of gasoline fuels to vaporize at low temperatures and pressures less than atmospheric is a function of the aromatic content and reid vapor pressure of the fuel. The trend of present gasolines and alcohol extended gasolines is toward a higher aromatic content and reid vapor pressure which greatly contributes to the vapor lock tendency. Vapor lock or near vapor lock can result in erratic engine operation, loss of power output, or at worst engine damage due to the leaning effect.

The current recommended practice for twin marine engine installations is to connect each engine to its own separate fuel feeding system, i.e., fuel tank withdrawal tube, anti-siphon valve, fuel feeding line and filter. This practice is recommended due to the fact that twin engines running off of one fuel feeding system results in high flow rates which, in turn, result in a greater tendency to form fuel vapor on the suction side of the engine fuel pumps.

SUMMARY OF THE INVENTION

This invention provides a fuel feed system for supplying fuel to an internal combustion engine, the system including a first fuel pump including an inlet adapted to be connected to a fuel tank, and an outlet, a fuel vapor separator including an inlet communicating with said first fuel pump outlet, and an outlet, and a second fuel pump communicating with the fuel vapor separator outlet.

In one embodiment, the fuel feed system further includes check valve means communicating with the first fuel pump inlet for permitting fuel flow to the first fuel pump and for preventing fuel flow from the first fuel pump, and a fuel filter located between the fuel vapor separator inlet and the first fuel pump outlet. The fuel feed system also includes check valve means communicating with the second fuel pump inlet and the fuel vapor separator outlet for permitting fuel flow from the fuel vapor separator outlet to the second fuel pump inlet and for preventing fuel flow from the second fuel pump inlet to the fuel vapor separator outlet.

In one embodiment, the fuel vapor separator comprises a float bowl having a vapor portion and a fuel portion for holding fuel, the fuel portion communicating with inlet and the fuel vapor separator outlet, a float operated check valve means located in the fuel vapor separator inlet for permitting fuel flow through the fuel vapor separator inlet when the fuel level in the fuel portion is below a predetermined level, and for preventing fuel flow through the fuel vapor separator inlet when the fuel level in the fuel portion is at or above the predetermined level, and a vent communicating with the vapor portion of the float bowl.

In another embodiment, the fuel vapor separator includes a second outlet communicating with the fuel portion.

In one embodiment, the fuel feed system further includes a priming system communicating the first fuel pump outlet with the second fuel pump inlet for priming, the priming system including a conduit extending between the first fuel pump outlet and the second fuel pump inlet, and a valve in the conduit and selectively operable to allow fuel passage through the conduit. The valve is a solenoid valve and the system further includes a priming switch operably connected to the solenoid valve.

This invention also provides a fuel feed system for supplying fuel to an internal combustion engine including a combustion chamber, the system including a fuel tank, a first fuel pump including an outlet, and an inlet communicating with said fuel tank, a fuel vapor separator including an outlet, and an inlet communicating with the first fuel pump outlet, and a second fuel pump communicating with the fuel vapor separator outlet and communicating with the combustion chamber.

In one embodiment, the engine includes an ignition system comprising an ignition switch and means operably connected to the ignition switch for igniting fuel in the combustion chamber in response to operation of the ignition switch, and the first fuel pump is an electrically operable pump and is adapted to be connected to the ignition switch and is operable in response to operation of the ignition switch.

In one embodiment, the fuel tank is adapted to be located remotely from the engine; and the first fuel pump, the vapor separator and the second fuel pump are adapted to be located adjacent the engine.

The invention also provides a fuel feed system for supplying fuel to a combustion chamber of a first internal combustion engine and a combustion chamber of a second internal combustion engine, the fuel feed system including a fuel tank, a first fuel pump including an outlet, and an inlet communicating with the fuel tank, a fuel vapor separator including a first outlet, a second outlet, and an inlet communicating with the first fuel pump outlet, a second fuel pump communicating with the fuel vapor separator first outlet and communicating with the first engine combustion chamber, and a third fuel pump communicating with the fuel vapor separator second outlet and communicating with the second engine combustion chamber.

One of the principal features of the invention is the provision of a fuel feed system which is especially suited for use with higher aromatic content gasolines and alcohol extended gasolines. The disclosed fuel feed system substantially reduces the amount of pressure drop which typically occurs in conventional systems prior to the introduction of the fuel to the engine fuel pump.

Another of the principal features of the invention is the provision of a fuel feed system which eliminates the need for a separate fuel tank and fuel feed line for a dual engine application, such as is in dual outboard marine engine applications.

Other features and advantages of embodiments of the invention will become known by reference to the following drawings, general description and dependent claims.

THE DRAWINGS

Figure 1:
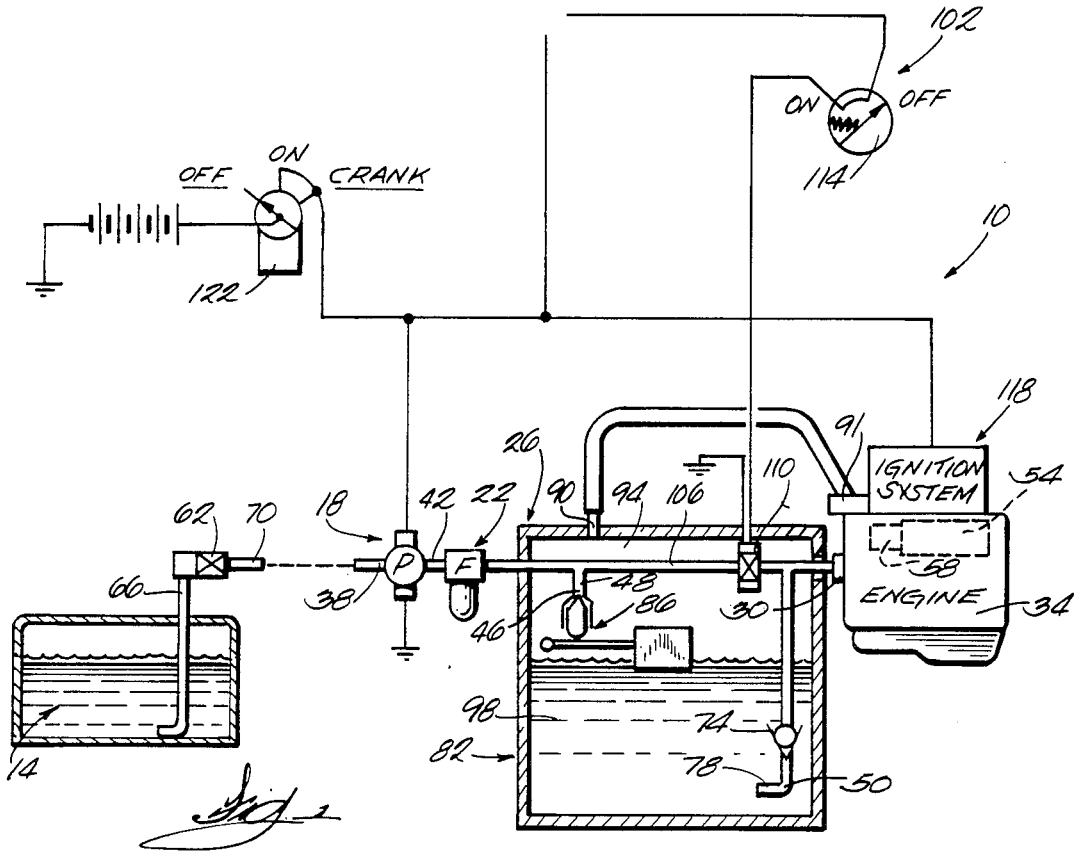
FIG. 1 is a schematic representation of a fuel feed system which is supplying fuel to an internal combustion engine and which embodies various of the features of the invention.

Before an embodiment of the invention is explained in detail, it is to be understood that the invention is not limited in its application to the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated in the drawings and more particularly in FIG. 1 is a fuel feed system 10 for supplying fuel to an internal combustion engine. The fuel feed system 10 includes, in serial fluid communication, a fuel tank 14, a first fuel pump 18, a fuel filter 22, a fuel vapor separator 26, a second fuel pump 30, and an internal combustion engine 34.

More particularly, the first fuel pump 18 includes an inlet 38 connected to the fuel tank 14 and an outlet 42. The fuel vapor separator 26 includes a fuel inlet 46 in communication through the fuel filter 22 with the first fuel pump outlet 42, and a fuel outlet 50, and the second fuel pump 30 is communicating with the fuel vapor separator outlet 50. Interiorly of the fuel vapor separator 26, the fuel inlet 46 includes a supply pipe 48, and the fuel outlet 50 includes a pick-up line or tube 78. Further, the internal combustion engine 34 includes a combustion chamber 54 and the second fuel pump 30 is communicating with a carburetor 58 communicating with the combustion chamber 54. Although other constructions can be used in other embodiments, in this embodiment, the second fuel pump 30 is in the form of a pneumatic combined fuel and oil pump driven by pressure fluctuations in the crankcase of a two cycle engine. Such a pump is described in Walsworth U.S. Pat. No. 4,539,949 which is incorporated herein by reference.

Although the fuel feed system 10 can be used with other internal combustion engines, the fuel feed system 10 is particularly adapted for use with an engine which forms a power head in a marine propulsion device such as an outboard motor.

Although other constructions can be used in other embodiments, the fuel feed system 10 further includes check valve means 62 communicating with the first fuel pump inlet 38 for permitting fuel flow to the first fuel pump 18 and for preventing fuel flow from the first fuel pump 18. More particularly, the check valve means 62 is located in a fuel pick-up line 66 which extends from the interior of the fuel tank 14 below the fuel level within the fuel tank 14 to exteriorly of the fuel tank 14. The fuel tank pick-up line 66 is connected to the first fuel pump inlet 38 by a conduit 70 of sufficient length to permit remote location of the fuel tank 14 from the engine 34.

After the fuel feed system 10 is no longer feeding fuel to the engine 34, such as when the engine 34 is shut off, it is desireable to avoid return fuel flow back into the fuel vapor separator 26 from the engine 34. Accordingly, means is provided for preventing such return fuel flow in the form of check valve means 74 communicating with the second fuel pump 30 and the fuel vapor separator outlet 50 for permitting fuel flow from the fuel vapor separator outlet 50 to the second fuel pump 30 and for preventing fuel flow from the second fuel pump 30 to the fuel vapor separator outlet 50. More particularly, the check valve means 74 is located in the fuel pick-up tube 78 included in the fuel vapor separator outlet 50.

Although other constructions can be used in other embodiments, the fuel vapor separator 26 comprises a float bowl 82, a float operated check valve means 86, and a vent 90. The float bowl 82 has an upper or vapor portion 94 and a lower or fuel portion 98 for holding fuel and located below the vapor portion 94. The fuel portion 98 communicates with the supply pipe 48 of the fuel vapor separator inlet 46, and with the pick-up tube or pipe 78 of the fuel vapor separator outlet 50. The float operated check valve means 86 is located in the supply pipe 48 and permits fuel flow through the fuel vapor separator inlet 46 and into the fuel portion 98 when the fuel level in the fuel portion 98 is below a predetermined level. Further, the float operated check valve means 86 prevents fuel flow through the fuel vapor separator inlet 46 when the fuel level in the fuel portion 98 is at or above the predetermined level.

The vent 90 communicates with the vapor portion 94 of the float bowl 82 and with a source of atmospheric pressure or below atmospheric pressure. More particularly, in the illustrated embodiment, the vent 90 communicates with the air induction system 91 of the internal combustion engine. In a two cycle engine application, the vent 90 can communicate with an air silencer, and, in a four cycle engine application, the vent 90 can communicate with a spark arrestor.

In order to allow for priming of the fuel feed system 10 after the engine 34 has been shut off or when the fuel feed system 10 has been allowed to run dry, means 102 is provided for priming the fuel feed system 10. More particularly, the priming means 102 communicates the first fuel feed pump outlet 42 with the second fuel pump 30. Although other constructions can be used in other embodiments, in the illustrated embodiment, the priming means 102 includes a conduit 106 extending between the first fuel pump outlet 42 and the second fuel pump 30, and a valve 110 which is located in the conduit 106 and which is selectively operable to allow fuel passage through the conduit 106. More particularly, the conduit 106 extends between the supply pipe 48 and the pick-up pipe 78 and the valve 110 is a solenoid valve, and the fuel feed system 10 further includes a priming switch 114 operably connected to the solenoid valve 110. The priming switch 114 is spring loaded to an "off" position where the valve 110 is closed in order to prevent the switch 114 from remaining in an activated "on" position where the valve 110 is open.

Although other constructions can be used in other embodiments, the engine 34 includes an ignition system 118 comprising an ignition switch 122 and means (not shown) operably connected to the ignition switch 122 for igniting fuel in the combustion chamber 54 in response to operation of the ignition switch 122. Such means operably connected to the ignition switch 122 for igniting fuel is considered conventional and is not described herein in detail.

Although various constructions can be used in other embodiments, in this embodiment, the first fuel pump 18 is electrically operable and is adapted to be connected to the ignition switch 122, and is operable in response to operation of the ignition switch 122 to turn "on" the ignition system 118. When the ignition switch 122 is in the "on" position, the electrical pump 18 operates continuously, but the output of the electrical pump 18 depends on the condition of the float valve 86 in the fuel vapor separator 26 and on the condition of the solenoid valve 110. If the float valve 86 is closed, the first fuel pump 18, although operating continuously, will not output any fuel to the fuel vapor separator 26. If the solenoid valve 110 is closed, the first fuel pump 18 will not output any fuel to the second fuel pump 30 via the conduit 106.

In outboard motor applications, the fuel tank 14 will usually be stored remotely from the internal combustion engine 34. The first fuel pump 18, the vapor separator 26, and the second fuel pump 30, however are located adjacent to the internal combustion engine 34.

Figure 2:
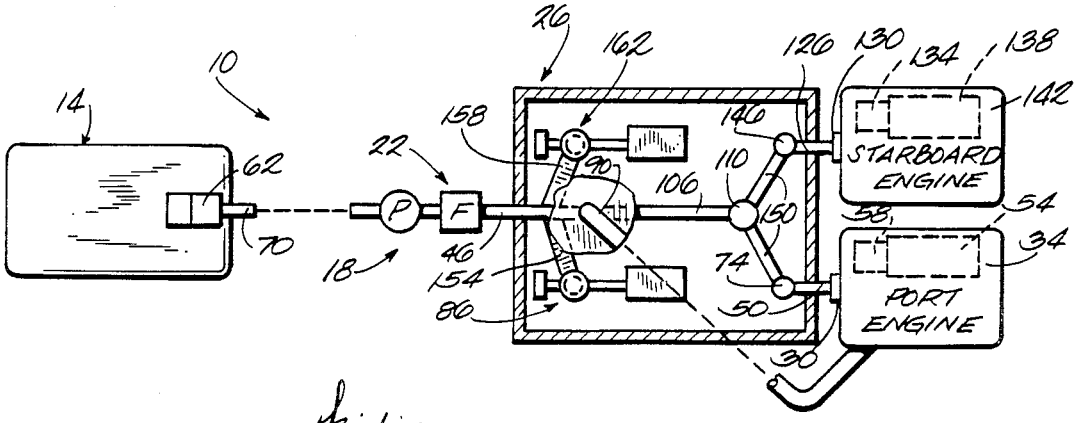
FIG. 2 is a top partial schematic representation of a fuel feed system which is supplying fuel to a first internal combustion engine and a second internal combustion engine and which embodies various of the features of the invention.

In an alternative construction, for applications where two or more internal combustion engines are used, such as in dual outboard motor applications where the engines are either operated together or one at a time, the fuel vapor separator 26 includes a plurality of fuel vapor separator outlets with each outlet associated with each of the internal combustion engines. More particularly, as illustrated in FIG. 2, the fuel vapor separator first outlet 50 is communicating with the second fuel pump 30 communicating with the combustion chamber 54 of the first engine 34, and the fuel vapor separator 26 has a second outlet 126 which is communicating with a third fuel pump 130. The third fuel pump 130 is communicating with a carburetor 134 communicating with the combustion chamber 138 of a second engine 142 . Each of the fuel vapor separator outlets 50 and 126, respectively, includes check valve means 74 and 146, respectively, for permitting fuel flow from the fuel vapor separator 26 to the engine fuel pumps 30 and 130, respectively, and for preventing fuel flow from the respective engine fuel pumps to the fuel vapor separator 26.

As before, the priming valve 110 is located in the conduit 106 which extends between the first fuel pump 18 and the respective fuel pumps 30 and 130. However, in this disclosed construction, in order to prevent air from one fuel pump reaching the other fuel pump when only one engine is operating, the conduit 106 includes two branch conduits 150 leading to the respective fuel pumps 30 and 130 from a common point or junction in the conduit 106, and the solenoid 110 is located in the conduit 106 at the junction between the branch conduits 150.

The fuel vapor separator inlet 46 also includes two branches or portions 154 and 158, which portions respectively include float valves 86 and 162 in order to reduce the required size of the float control valve for the vapor separator inlet 46.

With the fuel feeding system including the vapor separator as described, the engine fuel pumps have minimal inlet restriction, the inlet restriction being only the lift head height from the fuel level in the fuel vapor separator to the engine mounted fuel pump, the pressure drop across the fuel vapor separator outlet, and the short length of fuel line to the engine. This greatly reduced inlet restriction vastly minimizes the tendency for vapor formation or vapor lock.

Various of the features of the invention are set forth in the following claims.

I claim:

1. A fuel feed system for supplying fuel to an internal combustion engine, said system including a first fuel pump including an inlet adapted to be connected to a fuel tank, and an outlet, a fuel vapor separator including an inlet communicating with said first fuel pump outlet, and an outlet, a second fuel pump communicating with said fuel vapor separator outlet, and a priming system communicating between said first fuel pump outlet and said second fuel pump inlet, said priming system including a conduit extending between said first fuel pump outlet and said second fuel pump inlet, and a valve which is located in said conduit and selectively operable to allow fuel passage through said conduit.

2. A fuel feed system in accordance with claim 1 and further including check valve means communicating with said first fuel pump inlet for permitting fuel flow to said first fuel pump and for preventing fuel flow from said first fuel pump, and a fuel filter located between said fuel vapor separator inlet and said first fuel pump outlet.

3. A fuel feed system in accordance with claim 1 and further including check valve means communicating with said second fuel pump and said fuel vapor separator outlet for permitting fuel flow from said fuel vapor separator outlet to said second fuel pump and for preventing fuel flow from said second fuel pump to said fuel vapor separator outlet.

4. A fuel feed system in accordance with claim 1 wherein said fuel vapor separator comprises a float bowl having a vapor portion and a fuel portion for holding fuel, said fuel portion communicating with said vapor separator inlet and said fuel vapor separator outlet, a float operated check valve means located in said fuel vapor separator inlet for permitting fuel flow through said fuel vapor separator inlet when the fuel level in said fuel portion is below a predetermined level and for preventing fuel flow through said fuel vapor separator inlet when the fuel level in said fuel portion is at or above said predetermined level, and a vent communicating with said vapor portion of said float bowl.

5. A fuel feed system in accordance with claim 1 wherein said fuel vapor separator includes a second outlet communicating with said fuel portion, and wherein said system further includes a third fuel pump having an inlet communicating with said second fuel vapor separator outlet.

6. A fuel feed system in accordance with claim 1 wherein said valve is a solenoid valve and wherein said priming system further includes a priming switch operably connected to said solenoid valve.

7. A fuel feed system for supplying fuel to an internal combustion engine including a combustion chamber, said system including a fuel tank, a first fuel pump including an outlet, and an inlet communicating with said fuel tank, a fuel vapor separator including an outlet, and an inlet communicating with said first fuel pump outlet, a second fuel pump communicating with said fuel vapor separator outlet and communicating with the combustion chamber, and a priming system communicating said first fuel pump outlet with said second fuel pump inlet, said priming system including a conduit extending between said first fuel pump outlet and said second fuel pump inlet, and a valve located in said conduit and selectively operable to allow fuel passage through said conduit.

8. A fuel feed system in accordance with claim 7 and further including check valve means communicating with said fuel tank and said first fuel pump inlet for permitting fuel flow from said fuel tank to said first fuel pump inlet and for preventing fuel flow from said first fuel pump inlet to said fuel tank, and a fuel filter located between said fuel vapor separator inlet and said first fuel pump outlet.

9. A fuel feed system in accordance with claim 8 and further including check valve means communicating with said second fuel pump and said fuel vapor separator outlet for permitting fuel flow from said fuel vapor separator outlet to said second fuel pump and for preventing fuel flow from said second fuel pump to said fuel vapor separator outlet.

10. A fuel feed system in accordance with claim 7 wherein said fuel vapor separator comprises a float bowl having a vapor portion and a fuel portion for holding fuel, said fuel portion communicating with said fuel vapor separator inlet and said fuel vapor separator outlet, a float operated check valve means located in said fuel vapor separator inlet for permitting fuel flow through said fuel vapor separator inlet when the fuel level in said fuel portion is below a predetermined level and for preventing fuel flow through said fuel vapor separator inlet when the fuel level in said fuel portion is at or above said predetermined level, and a vent communicating with said vapor portion of said float bowl.

11. A fuel feed system in accordance with claim 7 wherein said valve is a solenoid valve and wherein said fuel supply means further includes a priming switch operably connected to said solenoid valve.

12. A fuel feed system in accordance with claim 7 and wherein the engine further includes an ignition system comprising an ignition switch and means operably connected to the ignition switch for igniting fuel in the combustion chamber in response to operation of the ignition switch, and wherein said first fuel pump is an electrically operable pump and is adapted to be connected to the ignition switch, and is operable in response to operation of the ignition switch.

13. A fuel feed system in accordance with claim 7 wherein said fuel tank is adapted to be located remotely from the engine, and wherein said first fuel pump, said vapor separator and said second fuel pump are adapted to be located adjacent the engine.

* * * * *